US006580257B2

(12) United States Patent
Marty

(10) Patent No.: US 6,580,257 B2
(45) Date of Patent: Jun. 17, 2003

(54) VOLTAGE REGULATOR INCORPORATING A STABILIZATION RESISTOR AND A CIRCUIT FOR LIMITING THE OUTPUT CURRENT

(75) Inventor: Nicolas Marty, Grenoble (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/253,399

(22) Filed: Sep. 24, 2002

(65) Prior Publication Data

US 2003/0085693 A1 May 8, 2003

(30) Foreign Application Priority Data

Sep. 25, 2001 (FR) ..... 01 12315

(51) Int. Cl.[7] ..... G05F 1/40
(52) U.S. Cl. ..... 323/280; 323/277
(58) Field of Search ..... 323/273, 274, 323/275, 276, 277, 278, 279, 280, 281

(56) References Cited

U.S. PATENT DOCUMENTS 6,175,724 B1 * 1/2001 Kadanka ..... 323/281
6,333,623 B1 * 12/2001 Heisley et al. ..... 323/280
6,501,253 B2 * 12/2002 Marty ..... 323/280

* cited by examiner

*Primary Examiner*—Jessica Han
(74) *Attorney, Agent, or Firm*—Lisa K. Jorgenson; Allen, Dyer, Doppelt, Milbrath & Gilchrist, P.A.

(57) ABSTRACT

A voltage regulator includes a power transistor for providing an electrical current to a load circuit connected to an output of the regulator. The delivered current is limited by a limitation circuit within the regulator. A stabilization resistor is connected between the power transistor and the output of the regulator. The limitation circuit includes a fixed-voltage generator, and a comparator for comparing the voltage generated in the stabilization resistor by the output current of the regulator with the fixed voltage. The output of the comparator controls an adjustment transistor that limits the current delivered by the power transistor.

20 Claims, 2 Drawing Sheets

VOLTAGE REGULATOR INCORPORATING A STABILIZATION RESISTOR AND A CIRCUIT FOR LIMITING THE OUTPUT CURRENT

FIELD OF THE INVENTION

The present invention relates to voltage regulators, and more particularly, to a voltage regulator equipped with a device for limiting an output current therefrom.

BACKGROUND OF THE INVENTION

A voltage regulator is a four-pole electrical device interposed between a source of electrical power and an electrical circuit. The electrical circuit is called a load circuit, and is supplied by the electrical power source. The type of electrical power source may vary, for example, between a chemical cell that is non-rechargeable and a battery that is rechargeable. Power sources do not necessarily deliver a constant output voltage. The output voltage may depend, for example, on a state of depletion of the power source, especially in the case of a chemical cell, or on the current charge of a battery.

The load circuit may be an electronic circuit intended for any application, such as a mobile radio communications terminal powered by its own battery. A voltage regulator is used when the load circuit requires a constant supply voltage for its operation, although the power source delivers a voltage that is variable along its duration of use. The function of the voltage regulator is to receive an input voltage that is variable, and to deliver a power-supply voltage that is substantially constant.

The voltage regulator is a low-drop-out (LDO) type if it operates even when the voltage difference between the power source and the nominal power-supply voltage becomes significantly reduced. In general, a stabilization capacitor is placed in parallel with the load circuit at the output of the voltage regulator. When a voltage is applied to the load circuit, a transient condition then occurs, during which the current delivered by the voltage regulator momentarily exhibits a very high level that is very capable of damaging the power source. It is then necessary to make provisions for limiting the electrical current levels delivered by the voltage regulator. This limitation also prevents damage which might result from an accidental short-circuit occurring in the load circuit, or from a high leakage current in the stabilization capacitor.

Devices exist for limiting the current delivered by a voltage regulator, and especially devices incorporated into the regulator itself. These devices are also called short-circuit protection circuits. In the particular case of LDO regulators which deliver an electrical power controlled by a power transistor contained in these regulators, one short-circuit protection method includes reproducing, in a circuit branch added to the regulator, the level of the electrical current delivered to the load circuit. This reproduced current level is obtained by using an additional transistor which, to within a scale factor, recopies the level of the current delivered by the power transistor to the load circuit.

The short-circuit protection is achieved by a limitation of the current level delivered by the power transistor when the recopied current level in the added circuit branch becomes greater than a previously fixed threshold. This threshold is chosen to prevent any damage that too high a current level delivered to the load circuit might cause.

FIG. 1 is an electrical diagram of a linear voltage regulator 1 according to the prior art. The electrical power delivered to the load circuit 20 is controlled by a power transistor 2. This transistor 2 may be a p-channel metal-oxide-semiconductor (PMOS) transistor, for example. The voltage regulator 1 receives a power supply voltage from an electrical power source 10, the positive terminal E of which is linked to the source of the power transistor 2. The drain of this transistor 2 is linked to the output terminal S of the regulator 1. The other output terminal of the regulator 1 is linked to ground. The power source 10 and the load circuit 20 are also linked to ground.

The transistor 2 is controlled on its gate by the output of an operational amplifier 11, which will now be referred to as an error amplifier. The error amplifier 11 is slaved by a feedback path starting from an intermediate node of a voltage-divider bridge 12 linked to the non-inverting input of this amplifier. The inverting input of the error amplifier 11 receives a reference voltage $U_{ref}$ that is fixed with respect to ground. The reference voltage $U_{ref}$ may be produced, for example, by a voltage source exploiting the forbidden band of a semiconductor material.

The voltage divider 12 is arranged in parallel with the load circuit 20 within the voltage regulator 1. The voltage divider 12 includes, for example, two resistors connected in series. One resistor 12*a* is connected between the terminal S and the feedback node, and the other resistor 12*b* is connected between the feedback node and ground. The respective values $R_a$, $R_b$ of these two resistors 12*a*, 12*b* are chosen as a function of the reference voltage $U_{ref}$ and of the desired power-supply voltage U, given that $U=U_{ref}*[(R_a+R_b)/R_b]$.

A stabilization capacitor 21 is placed in parallel with the load circuit 20, such as across its input. The capacitance of this stabilization capacitor 21 is 1 microfarad, for example.

The short-circuit protection circuit 100 of the voltage regulator 1 according to FIG. 1 includes a recopy transistor 13 operating under conditions similar to those of the power transistor 2. The illustrated recopy transistor 13 is also a PMOS transistor. The respective gates of these two transistors 2, 13 are linked together, as are their sources which are connected to the positive terminal E of the electrical-power source 10.

Under these conditions, the current level flowing in the transistor 13 recopies the current flowing in the power transistor 2. The level of the recopied current is compared using a transistor 14 with a fixed reference current $I_f$. The fixed reference current $I_f$ is produced by a current generator 15 placed between the drain of the recopy transistor 13 and ground. The transistor 14 is, for example, an n-channel metal-oxide-semiconductor (NMOS) transistor. The gate of the transistor 14 is connected between the drain of the recopy transistor 13 and the current generator 15. The source of the transistor 14 is linked to ground, and its drain is linked to the positive terminal of the power source 10 via a resistor 17.

Another PMOS transistor 16 has its gate linked to the drain of the NMOS transistor 14, and its channel is connected between the positive terminal E of the power source 10 and the output of the amplifier 11. This transistor 16 causes the voltage between ground and the gate of the power transistor 2 to rise when the level of the current recopied by the transistor 13 becomes greater than the level of the reference current $I_f$. Thus, the current level delivered to the load circuit 20 and which is controlled by the power transistor 2 is limited.

One drawback of this layout lies in the fact that the electrical power corresponding to the recopied current level is dissipated within the voltage regulator itself, i.e., in the current generator 15. This corresponds to electrical power delivered by the power source 10 that is lost with regards to the power supply for the load circuit 20.

In the case of a battery, a voltage regulator and a load circuit that are integrated into a self-contained electrical device, such as a mobile radio communications terminal, for example, lost electrical power associated therewith reduces the endurance of the device. This reduction in the endurance represents an important drawback for the use of this type of short-circuit protection regulator.

A partial approach for recopying the current includes using a transistor 13 such that the scale factor for recopying the current level flowing in the power transistor 2 is small, or even very small. However, such an approach made in terms of the choice of the physical dimensions of the transistors 2 and 13 is a constraint that is difficult to adapt to the selection of the type of recopy transistor 13 that can be correctly matched with the power transistor 2 in order to recopy the current level controlled by the latter.

SUMMARY OF THE INVENTION

In view of the foregoing background, an object of the present invention is to provide a voltage regulator that limits the output current therefrom with a slight impact on its electrical power consumption.

The present invention advantageously relates to a voltage regulator that includes an output resistor for stabilizing operation of the regulator. Voltage regulators may exhibit electrical characteristics leading to unstable conditions. The unstable conditions may be eliminated by the addition of a resistor at the output of the regulator. Such a resistor, called a stabilization resistor, has a low value, such as on the order of a few tenths of an ohm.

This and other objects, advantages and features in accordance with the present invention are provided by a voltage regulator comprising a power transistor having a control input, a first electrode linked to a first voltage supply terminal, and a second electrode linked to an output of the regulator by way of a stabilization resistor. An error amplifier has a first input for receiving a reference voltage with respect to a second voltage supply terminal, a second input for receiving a feedback voltage representative of the voltage on the second electrode of the power transistor with respect to the second supply terminal, and an output linked to the control input of the power transistor.

A protection circuit is preferably linked to the control input of the power transistor and to the voltage-supply terminals to limit the current delivered at the output of the regulator. The protection circuit may comprise voltage-adjustment means acting on the control input of the power transistor as a function of the voltage of the terminals of the stabilization resistor.

A voltage regulator according to the invention therefore does not include a circuit branch added to recopy the current level flowing in the power transistor. Therefore, the power dissipated within the regulator corresponding to recopying the current level is avoided. Furthermore, the short-circuit protection of the invention does not require an additional resistor with respect to the stabilization resistor placed at the output of the regulator. This further contributes to reducing the electrical power dissipated within the voltage regulator.

One particular embodiment of the protection circuit comprises means for delivering a fixed reference voltage with respect to the output of the regulator, and the voltage-adjustment means comprise a comparator which compares the voltage at the terminals of the stabilization resistor with the fixed reference voltage. The voltage-adjustment means may further comprise an adjustment transistor having a first electrode linked to the first voltage supply terminal, a second electrode linked to the control input of the power transistor, and a control input linked to an output of the comparator.

The adjustment transistor acts on the control input of the power transistor as a function of the state of the output of the comparator. This comparator is connected at one of its inputs so that when the voltage at the terminals of the stabilization resistor is higher than the fixed reference voltage, the adjustment transistor enters a conducting state. This causes the level of the current delivered to the load circuit to be regulated.

DETAILED DESCRIPTION OF THE PREFERRED EMBODIMENTS

Figure 1:
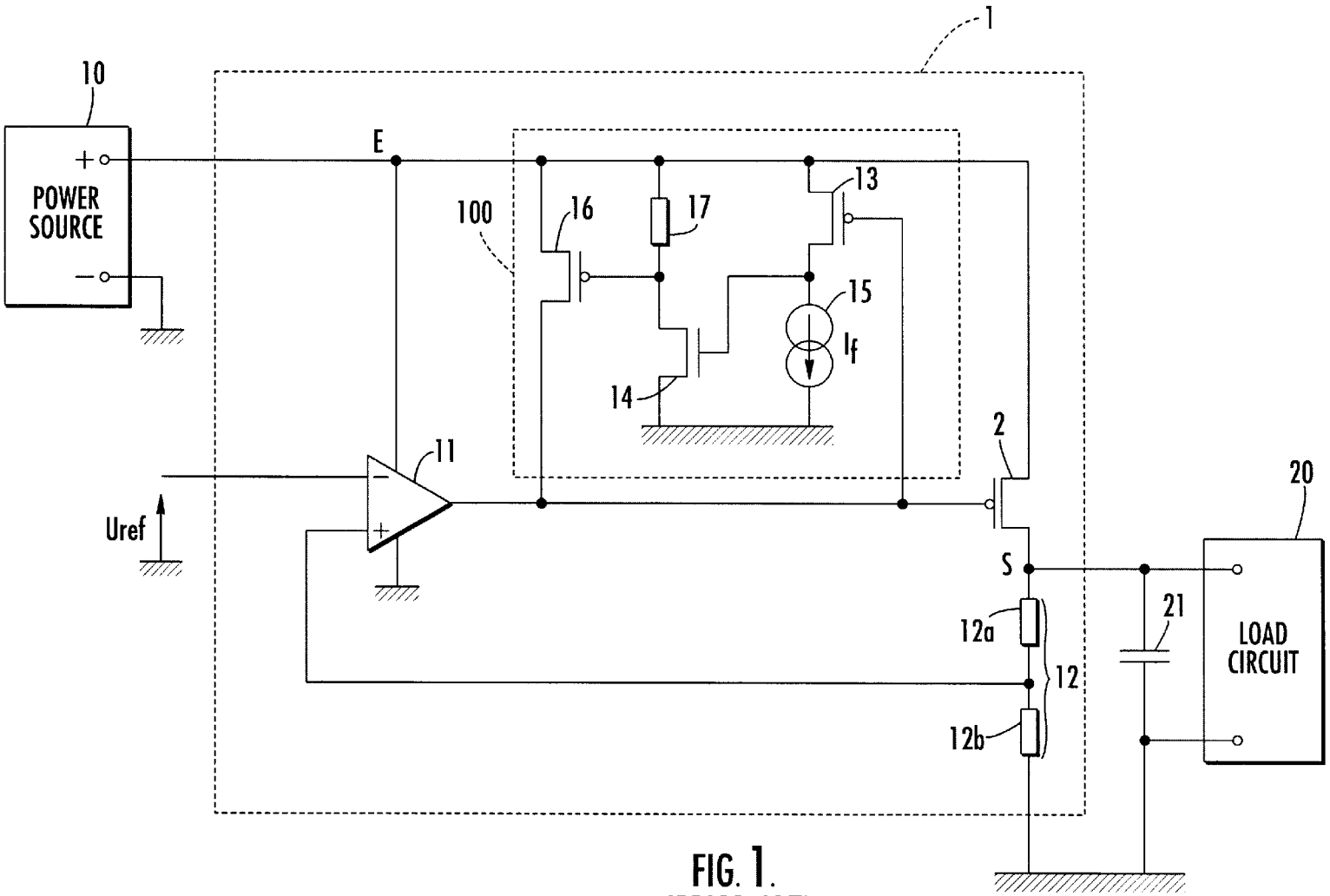
FIG. 1. (PRIOR ART)
FIG. 1 is an electrical diagram of a linear voltage regulator equipped with a short-circuit protection device according to the prior art.
Figure 2:
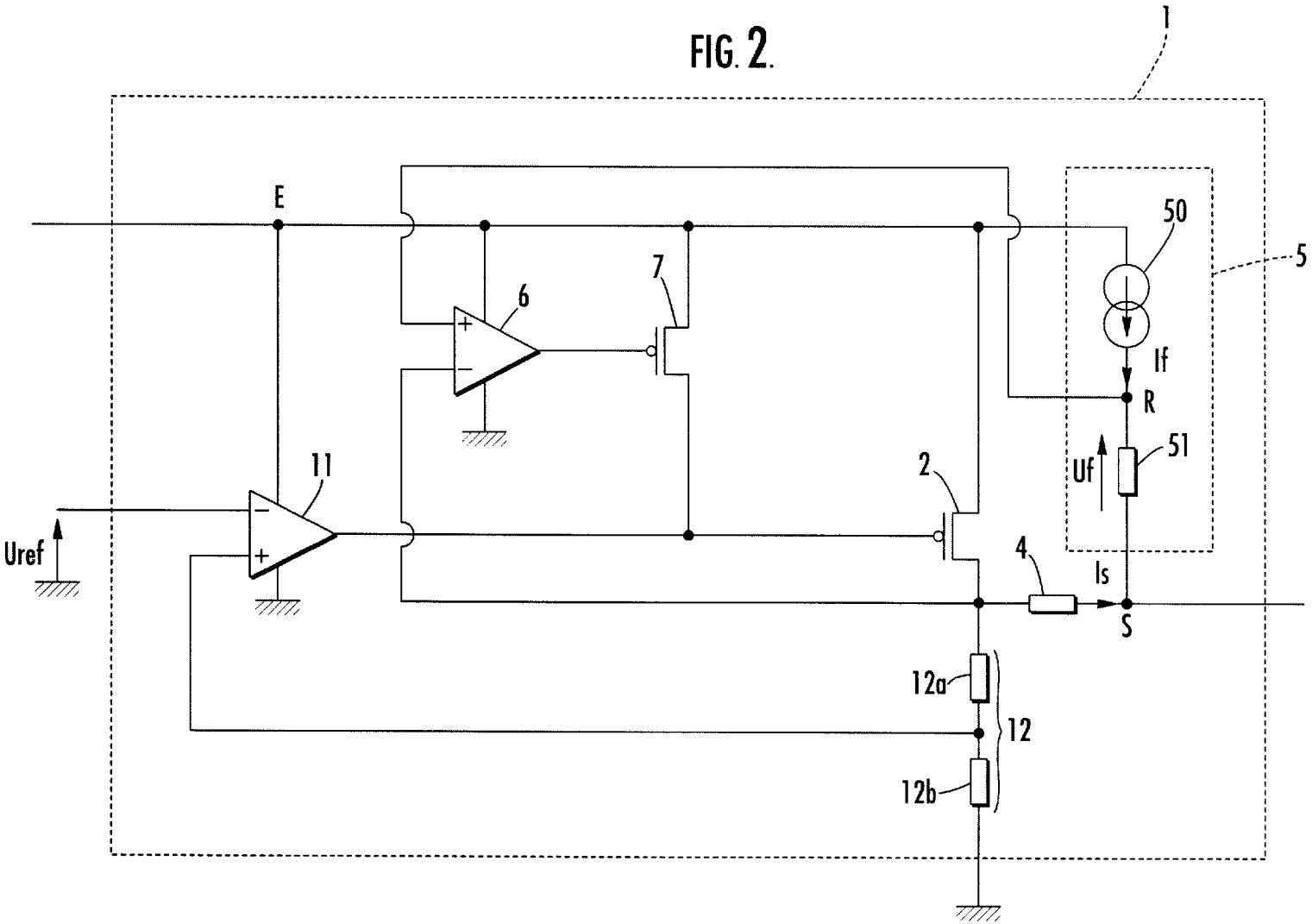
FIG. 2 is an electrical diagram of a preferred embodiment of a voltage regulator according to the present invention.

Apart from the circuit 100 for protecting against short-circuits, the LDO regulator 1 represented in FIG. 2 has a structure similar to that described in FIG. 1. The regulator 1 further comprises the stabilization resistor 4 arranged between the drain of the transistor 2 and the output terminal S. This resistor 4 exhibits a value of 0.3 ohms, for example. The value adopted for this resistor 4 corresponds to the minimum value that is sufficient to ensure stable operation of the voltage regulator 1.

By way of example, the positive voltage delivered by the power source lies between 3 and 5 V, with the reference voltage $U_{ref}$ being 1.4 V. By making the divider bridge 12 as illustrated, that is, with two resistors 12*a*, 12*b* having the same resistive value (such as 500 kΩ, for example), a regulator output voltage of 2.8 V is obtained.

To perform the voltage adjustment on the gate of the power transistor 2, the protection circuit comprises a voltage generator 5 and a comparator 6. The voltage generator 5 imposes a fixed voltage $U_f$ between a reference node of the regulator, denoted as R in FIG. 2, and the output terminal S.

The voltage generator 5 is formed, for example, by the current generator 50 arranged between the terminal E of the power source and the node R. The negative terminal of the current generator 50 is linked to the terminal E. The node R is linked, furthermore, to the output terminal S of the voltage regulator via a resistor 51. The fixed voltage $U_f$ is then the voltage at the terminals of this resistor 51. For example, the current imposed by the generator 50 is 1 microamp and the resistor 51 has a value of 150 kΩ. The voltage $U_f$ is then equal to 0.15 V, and this corresponds to the voltage between the node R and the output terminal S of the voltage regulator 1.

The comparator 6 compares the voltage at the terminals of the resistor 4 with the fixed voltage $U_f$. These two voltages are both referenced to the output terminal S. The comparator 6 has its two inputs connected respectively to the node R and to the drain of the power transistor 2.

In one particular embodiment, the comparator 6 comprises a low-consumption error amplifier. This consumption corresponds, for example, to a current of a few microamperes delivered by the power source 10. The inverting input of the error amplifier 6 is connected to the drain of the power transistor 2, and the non-inverting input is connected to the node R.

The protection circuit further comprises an adjustment transistor 7 for performing the voltage adjustment on the gate of the power transistor 2. The adjustment transistor 7 is a PMOS transistor, for example. The adjustment transistor 7 receives the output of the comparator 6 on its gate. The source of the adjustment transistor 7 is connected to the power-supply terminal E, and the drain is connected to the gate of the power transistor 2.

When the current delivered to the load circuit 20 by the voltage regulator 1 becomes too high, the voltage at the terminals of the resistor 4 exceeds the fixed voltage $U_f$. The level of the output current $I_S$ from the voltage regulator 1 corresponding to this threshold is approximately equal to $$I_S = \frac{R_{51}}{R_4} * I_f.$$

The variable $I_f$ designates the level of the current imposed by the current generator 50, $R_{51}$, designates the value of the resistor 51, and $R_4$ designates the value of the resistor 4. For the particular numerical values quoted above for each component, $I_S$=0.5 A. When this threshold is reached, the output voltage of the comparator switches over to 0 V. The adjustment transistor 7 begins to conduct, and this causes the voltage on the gate of the power transistor 2 to rise with respect to ground. This limits the current flowing between the source and the drain of the power transistor 2, and thus also limits the current delivered by the voltage regulator 1 to the load circuit 20.

In alternative embodiments of the layout of FIG. 2, the PMOS transistors can be replaced by corresponding NMOS transistors. They can also be replaced by bipolar transistors without the function and the general operation of the layout being changed. In other alternative embodiments of the layout of FIG. 2, the voltage divider 12 is replaced by a straightforward follower layout. In such a follower layout, the drain of the power transistor 2 is simply connected to the non-inverting input of the amplifier 11.

That which is claimed is:

1. A voltage regulator comprising:

a stabilization resistor having first and second terminals;

a power transistor having a control terminal, a first conduction terminal connected to a first voltage reference, and a second conduction terminal connected to the second terminal of said stabilization resistor;

an error amplifier having a first input for receiving a reference voltage, a second input for receiving a feedback voltage representative of a voltage on the second conduction terminal of said power transistor, and an output connected to the control terminal of said power transistor; and a protection circuit connected to the control terminal of said power transistor, to the first voltage reference and to a second voltage reference for limiting an output current, said protection circuit comprising voltage-adjustment means for adjusting a voltage on the control terminal of said power transistor based upon a voltage across the first and second terminals of said stabilization resistor.

2. A voltage regulator according to claim 1, wherein said protection circuit further comprises means for providing a fixed reference voltage with respect to the current provided at the output; and wherein said voltage-adjustment means comprises a comparator for comparing the voltage across the first and second terminals of said stabilization resistor with the fixed reference voltage.

3. A voltage regulator according to claim 2, wherein said voltage-adjustment means further comprise an adjustment transistor having a first conduction terminal connected to the first voltage reference, a second conduction terminal connected to the control input of said power transistor, and a control terminal connected to an output of said comparator.

4. A voltage regulator according to claim 1, further comprising a voltage divider between the second conduction terminal of said power transistor and the second voltage reference, said voltage divider having an intermediate node connected to the second input of said error amplifier.

5. A voltage regulator according to claim 1, wherein said power transistor comprises at least one of a PMOS transistor, an NMOS transistor, and a bipolar transistor.

6. A voltage regulator comprising:

a stabilization resistor;

a power transistor having a control terminal, a first conduction terminal connected to a first voltage reference, and a second conduction terminal connected to said stabilization resistor;

an error amplifier having a first input for receiving a reference voltage, a second input for receiving a feedback voltage representative of a voltage on the second conduction terminal of said power transistor, and an output connected to the control terminal of said power transistor; and a protection circuit for limiting current an output current, said protection circuit connected to said power transistor for adjusting a voltage on the control terminal thereof based upon a voltage across said stabilization resistor.

7. A voltage regulator according to claim 6, wherein said protection circuit provides a fixed reference voltage with respect to the output current, and comprises a comparator for comparing the voltage across said stabilization resistor with the fixed reference voltage.

8. A voltage regulator according to claim 7, wherein said protection circuit further comprises an adjustment transistor having a first conduction terminal connected to the first voltage reference, a second conduction terminal connected to the control input of said power transistor, and a control terminal connected to an output of said comparator.

9. A voltage regulator according to claim 6, further comprising a voltage divider between the second conduction terminal of said power transistor and a second voltage reference, said voltage divider having an intermediate node connected to the second input of said error amplifier.

10. A voltage regulator according to claim 6, wherein said power transistor comprises at least one of a PMOS transistor, an NMOS transistor, and a bipolar transistor.

11. An electrical circuit comprising:

a power source;

a load; and a voltage regulator connected between said power source and said load, and comprising a stabilization resistor, a power transistor having a control terminal, a first conduction terminal connected to said power source, and a second conduction terminal connected to said stabilization resistor, an error amplifier having a first input for receiving a reference voltage, a second input for receiving a feedback voltage representative of a voltage on the second conduction terminal of said power transistor, and an output connected to the control terminal of said power transistor, and a protection circuit for limiting an output current, said protection circuit connected to the control terminal of said power transistor for adjusting a voltage on the control terminal thereof based upon a voltage across said stabilization resistor.

12. An electrical circuit according to claim 11, wherein said protection circuit provides a fixed reference voltage with respect to the output current, and comprises a comparator for comparing the voltage across said stabilization resistor with the fixed reference voltage.

13. An electrical circuit according to claim 11, wherein said protection circuit further comprises an adjustment transistor having a first conduction terminal connected to said power source, a second conduction terminal connected to the control input of said power transistor, and a control terminal connected to an output of said comparator.

14. An electrical circuit according to claim 11, further comprising a voltage divider between the second conduction terminal of said power transistor and the first voltage reference, said voltage divider having an intermediate node connected to the second input of said error amplifier.

15. An electrical circuit according to claim 11, wherein said power transistor comprises at least one of a PMOS transistor, an NMOS transistor, and a bipolar transistor.

16. A method for limiting an output current from a voltage regulator connected between a power source and a load, the voltage regulator comprising a stabilization resistor; a power transistor having a control terminal, a first conduction terminal connected to the power source, and a second conduction terminal connected to the stabilization resistor; an error amplifier having a first input for receiving a reference voltage, a second input for receiving a feedback voltage representative of a voltage on the second conduction terminal of the power transistor, and an output connected to the control terminal of the power transistor; and a protection circuit connected to the control terminal of the power transistor, the method comprising:

determining a voltage across the stabilization resistor; and adjusting a voltage on the control terminal of the power transistor for limiting the output current based upon the voltage across the stabilization resistor.

17. A method according to claim 16, wherein determing the voltage comprises:

providing a fixed reference voltage with respect to the output current; and comparing the voltage across the stabilization resistor with the fixed reference voltage.

18. A method according to claim 17, wherein the comparing is performed by a comparator; and wherein the protection circuit further comprises an adjustment transistor having a first conduction terminal connected to the power source, a second conduction terminal connected to the control input of the power transistor, and a control terminal connected to an output of the comparator.

19. A method according to claim 16, further comprising a voltage divider between the second conduction terminal of the power transistor and a first voltage reference, the voltage divider having an intermediate node connected to the second input of the error amplifier.

20. A method according to claim 16, wherein the power transistor comprises at least one of a PMOS transistor, an NMOS transistor, and a bipolar transistor.

* * * * *